United States Patent [19]

Stahlecker et al.

[11] 4,178,748

[45] Dec. 18, 1979

[54] OPEN-END SPINNING MACHINE APPARATUS WITH A TRAVELING DEVICE FOR BOBBIN EXCHANGE AND METHOD OF USING SAME

[76] Inventors: Fritz Stahlecker, Josef-Neidhart-Str. 18, 7341 Bad Überkingen; Hans Stahlecker, Haldenstrasse 20, 7334 Süssen, both of Fed. Rep. of Germany

[21] Appl. No.: 792,556

[22] Filed: May 2, 1977

[30] Foreign Application Priority Data

May 8, 1976 [DE] Fed. Rep. of Germany ..... 2620428

[51] Int. Cl.[2] ..... D01H 15/00; D01H 9/10

[52] U.S. Cl. ..... 57/263; 57/268; 242/35.5 A

[58] Field of Search ..... 242/35.5 A, 35.5 R, 242/35.6 R, 18 R, 18 DD, 41; 57/34 R, 53, 54, 52, 263, 268, 270

[56] References Cited

U.S. PATENT DOCUMENTS

| | | | |
|---|---|---|---|
| 1,700,425 | 1/1929 | Abbott et al. | 242/35.6 R |
| 3,476,328 | 11/1969 | Shimai et al. | 242/35.5 R |
| 3,640,059 | 2/1972 | Lutovsky et al. | 242/35.6 R X |
| 3,791,126 | 2/1974 | Kose et al. | 242/35.5 A X |
| 3,811,631 | 5/1974 | Mayer et al. | 242/35.5 A X |
| 3,820,730 | 6/1974 | Endo et al. | 242/35.5 R |
| 3,858,385 | 1/1975 | Shinkai et al. | 57/34 R |
| 3,879,925 | 4/1975 | Yoshizawa et al. | 242/35.5 A X |
| 3,971,520 | 7/1976 | Shimai | 242/35.5 A |
| 4,015,786 | 4/1977 | Slavik et al. | 242/35.5 A |

*Primary Examiner*—Stanley N. Gilreath
*Attorney, Agent, or Firm*—Craig and Antonelli

[57] ABSTRACT

Spinning machine apparatus is provided which includes a plurality of open-end spinning units, each of said spinning units being provided with a bobbin holder for holding bobbins to wind up the thread produced at the spinning unit. A supply station is fixedly disposed at each spinning unit for storing a supply of empty spool tubes provided with starter threads. A traveling servicing device is guided on tracks adjacent the spinning units and includes lever mechanisms for effecting removal of a full bobbin and replacement thereof with one of the supply of empty spool tubes at the respective supply station. According to preferred embodiments, the method of utilizing the apparatus includes manually filling the supply stations at the spinning units, with the traveling servicing device being automatically operated to effect the tube transfer operation.

9 Claims, 8 Drawing Figures

OPEN-END SPINNING MACHINE APPARATUS WITH A TRAVELING DEVICE FOR BOBBIN EXCHANGE AND METHOD OF USING SAME

BACKGROUND AND SUMMARY OF THE INVENTION

The invention relates to a spinning machine, preferably an open-end spinning machine, with a plurality of spinning units, each of said units being provided with a bobbin holder for bobbins which take up the threads which are produced, and with a device traveling on tracks, said device comprising a means for removing full bobbins from the bobbin holders and a means for taking tubes to be wound from a supply station and loading them on the bobbin holders.

It is known in winding machines (Austrian Pat. No. 2 73 742) to automate bobbin changing, a magazine for empty tubes and a stationary bobbin changer being provided at each winding position. After reaching a preset diameter, the full bobbin is transferred to a conveyor belt traveling along the length of the machine, without interrupting the winding process. Simultaneously the bobbin changer provides an empty tube which is loaded on the bobbin holder. Additional means ensure that the thread, continuing to move without interruption, is then wound around the empty tube. It is only at this point that the thread is broken between the tube and the full bobbin.

A traveling bobbin changer is also known (German Offenlegungsschrift No. 2,502,946) generally designed for textile machinery. In this design, means are provided to ensure that the thread continues moving as a full bobbin is replaced by a tube to be wound. In this design, means are also provided to ensure that the full bobbin and the tube to be wound are driven during the changeover process.

It is advantageous in open-end spinning machines to have the bobbin change accomplished largely automatically. A number of devices for this purpose are known, which likewise use the basic principle known from the designs mentioned hereinabove, and exchange a tube to be wound for a full bobbin without interrupting the spinning process. In one known design (German Offenlegungsschrift No. 2,400,081), a traveling device carries the empty tubes to be exchanged for full bobbins with it. This design comprises a swivelable change arm, said arm being provided with means for opening the bobbin holder of a spinning unit, said arm also being provided with a curved panel to accept the full bobbin and to guide said bobbin to a conveyor belt. The change arm is also provided with a gripper which removes the empty tube from a magazine carried along with it and loads the tubes on the bobbin holders. This device has large dimensions owing to the magazine it carries with it, with presorting and preparation of the empty tubes being accomplished in the magazine in a complicated manner. In addition, a device of this type is very expensive. Since the movement of the thread must not be interrupted with this machine, considerable expense is required to maintain thread guidance during the changeover process. During these operations, the thread is subjected to stress in excess of normal, so that there is an increased danger of the thread breaking. If the thread should break during the replacement of the bobbin, it is extremely disadvantageous since the thread can no longer be wound on automatically because no free thread end is available which can be taken up by the tube to be wound and used for starting the winding-on process. Hence, the entire device must be designed very carefully so that it operates with extremely high precision in order to avoid breaking the thread, since a break would result in a considerable drop in production for the reasons given above.

In co-pending U.S. application Ser. No. 658,532, filed Feb. 17, 1976, now U.S. Pat. No. 4,125,990, issued Nov. 21, 1978, other bobbin changing appartus is disclosed which includes embodiments with empty spool tubes stored on the traveling device, as well as mechanisms for applying starter windings on the empty spool tubes preliminary to placing them in the bobbin holder. The present invention is a further improvement on the apparatus of this co-pending application. The subject matter of this co-pending application is hereby incorporated by reference thereto herein to the extent needed for an understanding of the present invention.

An object of the invention is to provide a traveling device for changing bobbins on an open-spinning machine, said device being simple and economical to manufacture and operating in a reliable fashion.

The invention contemplates making the device for accepting the tubes to be wound adjustable relative to the supply stations provided in fixed positions relative to each spinning unit, said supply stations holding in readiness at least one tube to be wound, said tube being provided with a thread of a length sufficient for use as a first winding for at least one winding-on process.

The invention is based in part, on recognition of the fact that there is very little difficulty associated in practice with supplying the tubes to be wound to stationary supply stations, each of which is associated with a spinning unit. This can be accomplished manually by machine operators, for example. The invention is also based, in part, on recognition of the fact that bobbins can be most easily replaced during interruption of the spinning. This has the advantage that complicated devices can be avoided which are designed to maintain thread travel during bobbin exchange. This also eliminates the risk of a thread breaking inadvertently, which interferes with automatic starting of the winding-on process. Rather, a provision is made in which the tube to be wound is provided with a first winding which permits automatic starting of the winding-on process, which must be carried out after each bobbin change.

On the whole, it may be assumed that the spinning unit, which holds a full bobbin, is also scheduled (for other reasons) for a maintenance procedure, involving in particular a cleaning of the spinning rotor. For this reason, a further configuration of the device of the invention is provided in which the traveling device is designed as a maintenance unit, said unit containing means for carrying out maintenance operations, said operations serving as a preparation for automatic winding-on. For example, it can be arranged for the means accomplishing a bobbin change to be mounted on a traveling cleaning device, said cleaning device being followed by an independent traveling device for winding-on.

These and other objects, features and advantages of the present invention will become more apparent from the following description when taken in connection with the accompanying drawings, which show, for purposes of illustration only, several embodiments in accordance with the present invention.

DETAILED DESCRIPTION OF THE DRAWINGS

Figure 1:
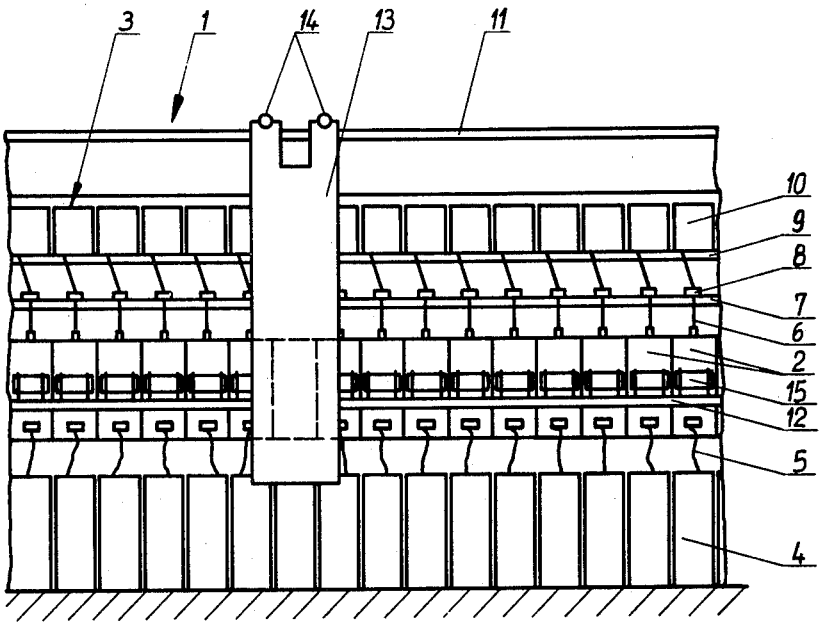
FIG. 1 shows a schematic front view of an open-end spinning machine with a traveling device for changing bobbins constructed in accordance with a preferred embodiment of the present invention.

The open-end spinning machine 1 shown in FIG. 1 is provided with a plurality of spinning units 2 disposed side by side, with a winding device 3 associated with each of said units. A sliver 5 is guided to each spinning unit 2 from sliver cans 4. The fiber material is then wound on winding bobbins 10 in the form of a spun thread 6, said bobbins being driven by friction rollers 9. Take-up rollers 7, 8 are provided as a delivery system. Tracks 11, 12 are mounted along the length of open-end spinning machine 1, with a device 13 traveling along said tracks by means of rollers 14. As shown schematically in FIG. 1. supply stations for spool tubes 15 to be wound are associated with each spinning unit 2. These spool tubes or empty tubes 15 are loaded approximately once a day by a machine operator, whereupon the traveling device 13 performs the changing operation, i.e., exchanges the corresponding empty tube 15 for the full bobbin 10, when bobbin 10 is fully wound. This combined operating procedure, i.e., manual loading of tubes 15 followed by automatic bobbin changing, has proved to be especially advantageous.

Figure 2:
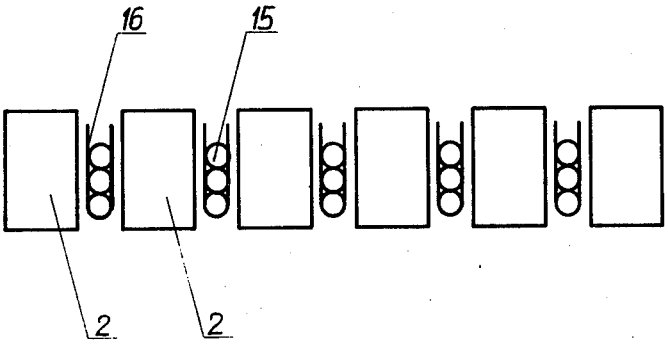
FIG. 2 is a schematic representation of a plurality of spinning units of an open-end spinning machine, with supply stations mounted therebetween for spool tubes to be wound.

In FIG. 2, a plurality of spinning units 2 mounted side by side are shown purely schematically; supply stations 16 are located between these spinning units, each station holding a plurality of tubes 15. This arrangement is advantageous when smaller spinning units 2 are used, especially for smaller yarn numbers. Open-end spinning machines 1 are commonly made with a fixed preset spacing throughout for reasons of efficiency. In other words the distance between the centers of the spinning units 2 is fixed, so that when larger spinning units 2 are used the latter rest directly against one another, while when smaller spinning units 2 are used a small space is left between them, said space advantageously lending itself to use for supply stations 16.

Open-end spinning unit 2 (FIG. 3) includes a rotor housing 17 containing a spinning rotor 21, a bearing housing 18 for rotor shaft 22, and an opener housing 19; said housing 19 being swivelable about a stationary axis 20 and containing feed and separating device 23. Spinning unit 2 is mounted on a machine frame 25. The spun thread 6 is pulled from a yarn delivery channel 24 by means of take-up rollers 7, 8 through a broken-end detector 26 and wound on bobbin 10, said bobbin resting on a friction roller 9 in the operating state. Machine frame 25 has mounted thereon tracks 11 and 12, upon which wheels 14, described in FIG. 1, of which at least one is driven, and additional wheels 27 and 28 of device 13, serving to accept horizontal forces, run. Device 13 is also capable of serving as a component of an additional maintenance device.

Figure 3A:
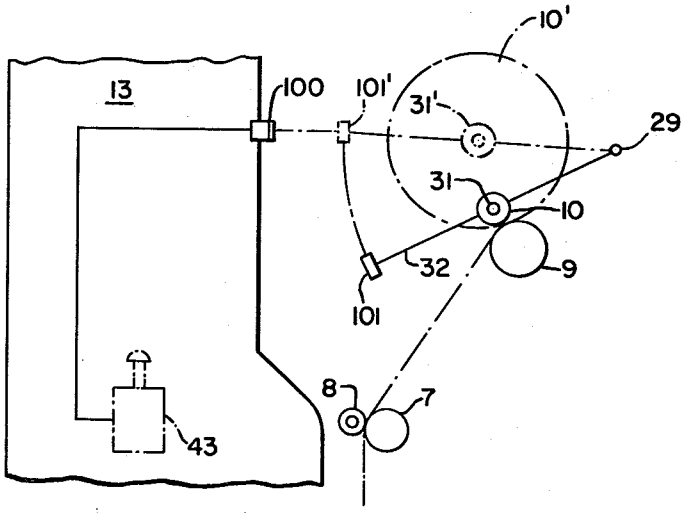
FIG. 3A is a sectional view schematically showing a bobbin fullness detector usable with the invention.
Figure 3:
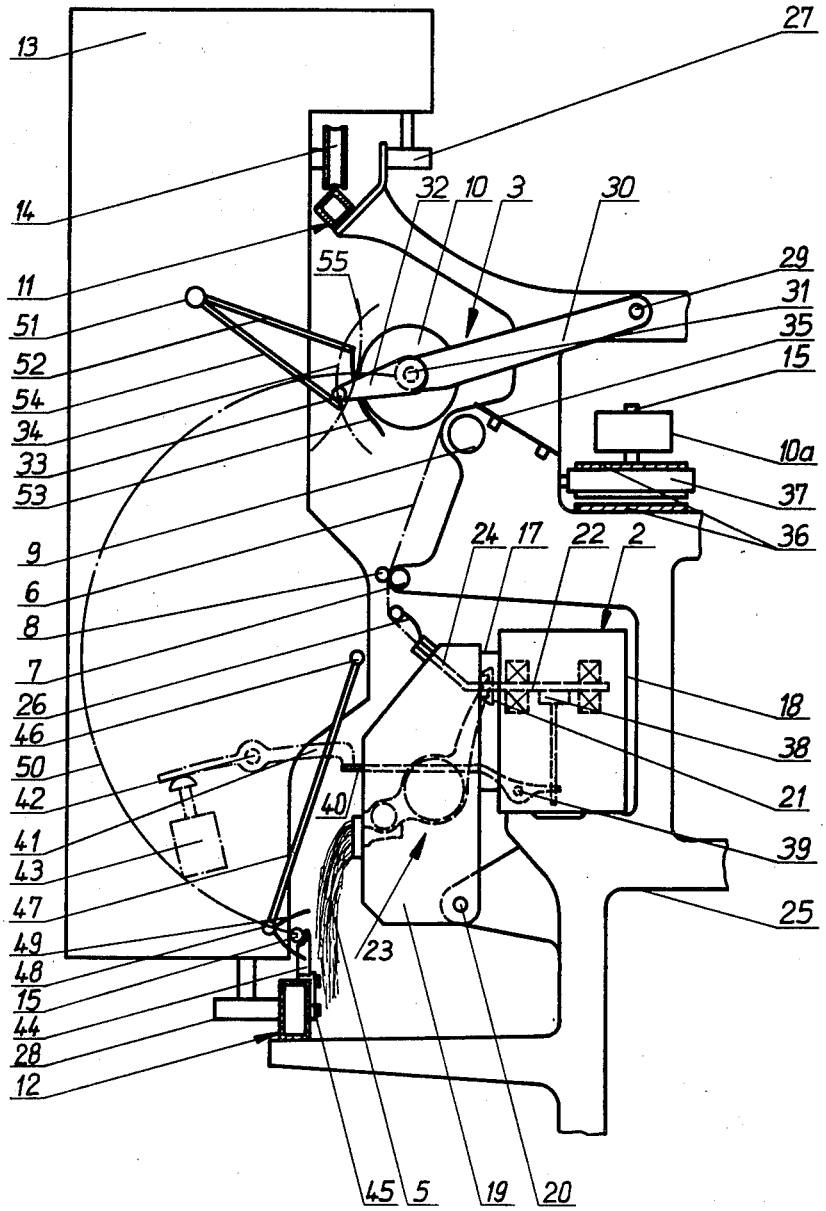
FIG. 3 is a cross sectional view through an open-end spinning machine with a device for accomplishing a bobbin change constructed in accordance with the present invention.

Take-up device 13 includes a bobbin holder 30 swivelable about an axis 29, said holder supporting bobbin 10 by means of lateral tube guides 31. This bobbin 10 rests on friction roller 9 in the operating state, i.e., during the spinning process, and is lifted off the roller during the bobbin change. It is necessary in the changeover process to spread the bobbin holder apart slightly, for which purpose spreading arms 32, which in the present case can also be swivelable, and guide pin 33 are provided. Spreading arms 32 with guide pins 33 can be swiveled through an arc 34 about tube guide 31. During the bobbin change, as will be described hereinbelow, the full bobbin 10 is pushed off bobbin holder 30, and then is guided via a smooth panel 35 to a conveyor belt 36, which extends lengthwise along the center of the machine. (FIG. 3 illustrating only the lefthand side of a machine having similar structure at the right side as viewed in FIG. 3.) Means are provided (not shown) which ensure that the bobbin can rest only upon one end face of tube 15 during its transport to the center of the machine (reference number 10*a*). Conveyor belt 36 is guided on rollers 37.

Since the bobbin change according to the present invention is to be carried out with the spinning interrupted considerably simplifying the construction, means are provided to ensure that the traveling device itself can interrupt the spinning operation of the spinning unit 2 in question. In addition, traveling device 13 is preferably equipped with means for determining the degree of fullness of bobbin 10 and carrying out a bobbin change when bobbin 10 is full. FIG. 3A schematically depicts an arrangement for detecting the filling condition of the bobbin 10 at a spinning unit. Device 13 carries a detector 100 which senses a reflector 101 carried by arm 32 of the bobbin holder when it is carried to the position shown in dash lines (and primed reference numerals) with a full bobbin. In this arrangement, use is made of the fact that filling the bobbin is accompanied by movement of arm 32 and reflector 101 toward the position where detector 100 can detect the same, for example, by means of an optical or other signal. Detector 100 provides a signal to solenoid 43 to initiate the bobbin exchange. Commonly assigned copending application Ser. No. 732,880, filed Oct. 15, 1976, discloses such a bobbin fullness detector for use in conjunction with other servicing equipment. A brake 38 is provided in bearing housing 18 of spinning unit 2, said brake being capable of engaging rotor shaft 22 by means of double lever 40, swivelable about axis 39. In this manner, spinning rotor 21 can be halted by being engaged externally, so that no more of thread 6 is pulled off. Traveling device 13 is provided with an actuating lever 41 (indicated by a dot-dashed line), said lever being swivelable about axis 42, said lever further being actuated by an actuating element 43 made in the form of a solenoid operated by an electrical signal responsive to the bobbin exchange sequence initiated by the full bobbin detecter, against the force of a spring (not shown).

In this manner, the traveling device can actuate rotor brake 38 and interrupt the spinning process in spinning unit 2.

Figure 6:
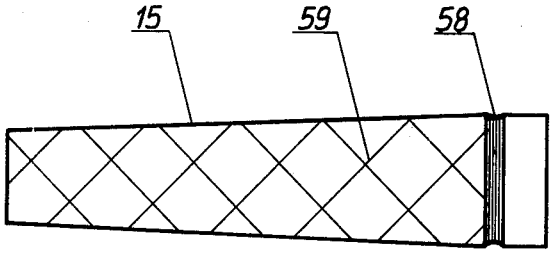
FIG. 6 is a side view of a spool tube to be wound, with a first winding.

An elastic holder 44 for empty tubes 15 is provided preferably as a supply station on track 12 of open-end spinning machine 1 in this FIG. 3 embodiment. Holder 44 is adjustably mounted on track 12 by means of an adjustable mount 45. In this manner, the supply station of each individual spinning unit 2 can be adjusted exactly with reference to the traveling device 13 traveling on track 12. Empty tube 15, placed manually in empty-tube holder 44, is already provided with a first winding, which can be prepared very rapidly and efficiently on known separate machines. The purpose of this first winding, on the one hand, is to form a thread reserve on tube 15 which will facilitate subsequent operation, and on the other hand to make possible an automatic winding-on after the bobbin change. FIG. 6 shows such an empty tube 15 provided with a thread reserve 58 in a separate groove and provided with a first winding 59.

To guide empty tubes 15 to wind-up device 3, device 13 is provided with a gripper arm 47 swivelable about axis 46, gripping fingers 49, preferably controlled, being provided on said gripper arm in a pivot joint 48. The arrangement is preferably such that the empty-tube holder 44 grips tubes 15 only at their outer ends, leaving the middle area of tubes 15 free for gripping fingers 49. Gripper arm 47, gripping empty tube 15, is swivelable along arc 50 shown as a dot-dashed line, said arc intersecting the arc described by tube receptacle 31 of bobbin holder 30 as it swivels about its axis 29. U.S. Pat. Nos. 3,879,925 and 3,939,634 shows various bobbin gripping and moving mechanism features in conjunction with bobbin exchangers having empty tubes carried by the movable maintenance device. These features could also be used to effect the gripping, moving and insertion of the empty tubes in practicing the present invention as described herein.

Before the empty tube 15 is fed to wind-up device 3, it is first necessary to guide full bobbin 10 to conveyor belt 36 via conveyor panel 35. For this purpose, a lever 54 swivelable about axis 51 is provided, having a swiveling radius 55 and capable of spreading bobbin frame 32 with engagement of pin 33. In addition, a lifter 52 is swivelable about axis 51 independently of lever 54, said lifter being provided at its end with a shaped panel 53, said panel 53 pressing against bobbin 10 and feeding bobbin 10 to conveyor belt 36 in the middle of the machine when bobbin frame 32 is spread. The entire arrangement is advantageously designed so that lever 54 initially lifts bobbin holder 30 slightly, lifting bobbin 10 off friction roller 9. When panel 53 of lifting lever 52 rests against bobbin 10, lever 54 spreads bobbin frame 32 in known fashion, such as shown and described in the above-noted U.S. Pat. No. 4,125,990. During this process, empty tube 15 can already be gripped by gripper fingers 49 and placed on the bobbin holder. To accommodate placing of empty tube 15 in the gripper fingers 49, the levers 52 and 54 are disposed so as to leave a space for fingers 49.

Figure 4:
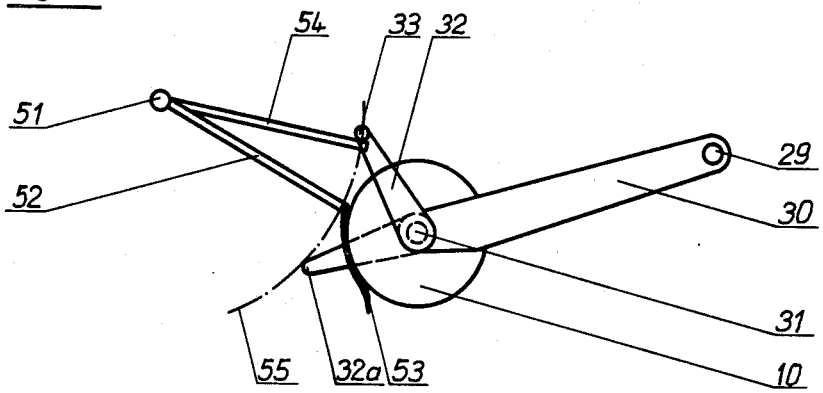
FIG. 4 is a partial view of the embodiment according to FIG. 3 in another operating state.

FIG. 4 shows how lever 54 swivels upward by application of one of the two arms of the bobbin frame 32 against only pin 33, while the other bobbin frame **32*a* remains in position, i.e., constitutes an extension of bobbin holder 30. This swiveling involves a spreading of bobbin frame 32, whereby bobbin 10 is released and the new empty tube 15 can be loaded. At the same time, it is obvious that lifting lever 52 presses against bobbin 10 with its panel 53**.

Figure 5:
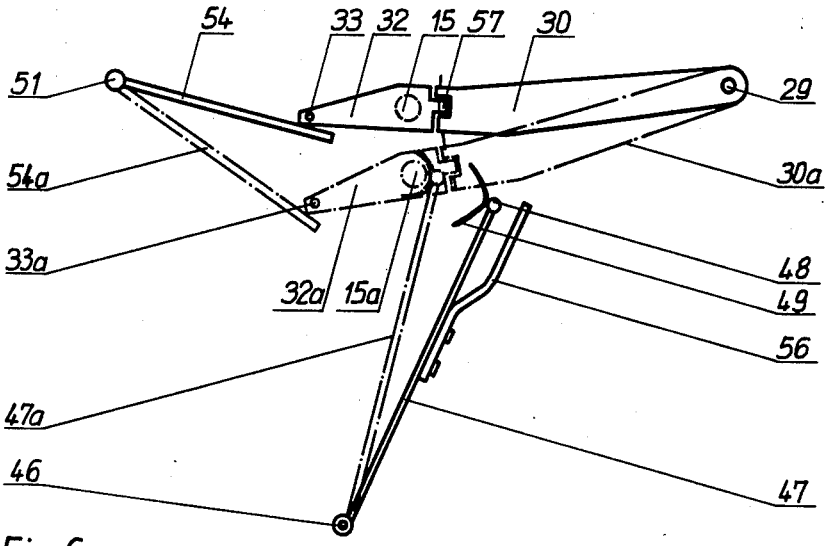
FIG. 5 is a partial view of a further unit of FIG. 3, in yet another later operating state.

The arrangement according to FIG. 5 can also be designed so that bobbin frame 32 is only spread outward, without being swiveled upward separately. FIG. 5 shows a first position in dot-dashed outline and a later position with a solid outline. While lever **54*a*, shown in dot-dashed outline, initially lifts bobbin holder and pin 33*a* slightly and then spreads bobbin frame 32*a* slightly outward by means not shown in greater detail (such as interengageable camming surfaces on frame 32*a* and lever 54*a*), gripper arm 47*a* can load empty tube 15*a* on bobbin holder 30. Then gripper arm 47 swivels a little farther to the position shown by the solid lines, releasing empty tube 15*a*. Lever 54 then pushes (or permits movement of) the entire bobbin holder 30 (solid line), taking empty tube 15 with it, so that gripper arm 47 can swivel back. The details of the spreading the bobbin frame are not shown, since they are known from the state of the art. In the design according to FIG. 5, it is also provided that a panel 56 is mounted on gripper arm 47, said panel pushing the full bobbin out of the holder. In this manner, lifting lever 52** can be eliminated.

Figure 1A:
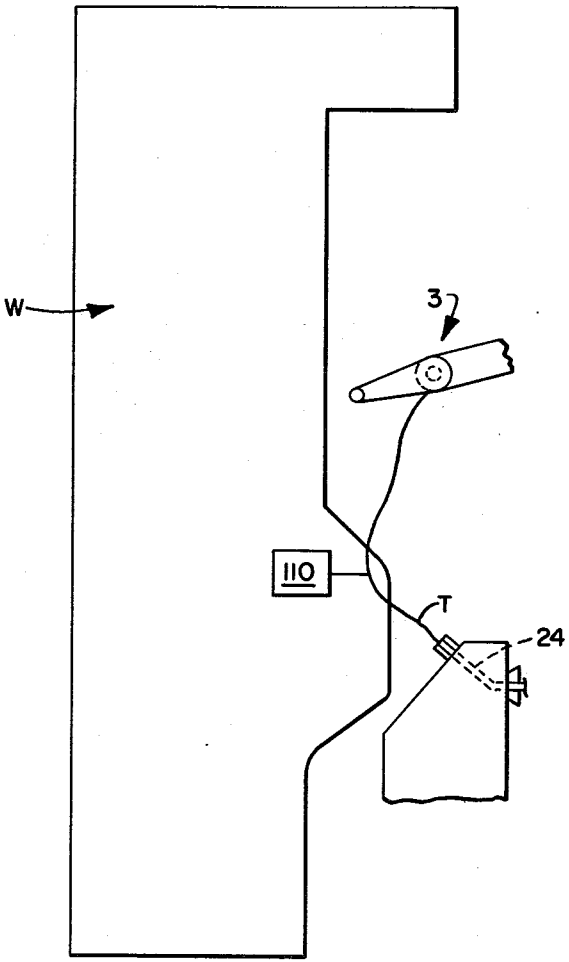
FIG. 1A is a schematic sectional view of a winding on device usable with the present invention.

The device described hereinabove, with its variations, offers a number of advantages over the state of the art. The manual loading of the tubes followed by automatic replacement of full bobbins 10 by tubes 15 keeps automation (and therefore investment cost) within tolerable limits. Those stages of the operation which can be carried out easily even by machine operators have been left manual. The geometry between the empty-tube holder 44 and the tube guide 31 of bobbin holder 30 in the raised state is such that the required lever mechanism can be kept very simple. By providing a first winding on tube 15, which can be accomplished in a very efficient and known fashion, it is no longer necessary to provide additional means to ensure that the spinning process is not interrupted. A winding-on device, known of itself (for example, see commonly owned U.S. Pat. Nos. 3,892,062; 3,942,311; 3,924,393; and 3,924,394) and connected to device 13 or traveling behind it, can find the thread and immediately wind it on again by returning, a free end of the starter thread to a spinning rotor of a spinning unit, since one turn of yarn is already present on tube 15 after it is loaded on bobbin holder 30. FIG. 1A schematically depicts such a winding on device W, which includes a thread end return mechanism 110 for returning a free end of the starter thread T to the spinning rotor via yarn delivery channel 24 to accommodate a piecing operation in a known manner. Production losses resulting from drawing off the thread, which otherwise would continue to be supplied, are eliminated, and a plurality of unsuccessful attempts is permissible, since the tube 15 mounted on wind-up device 3 contains a sufficient supply of yarn to resume spinning.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the detais shown and described herein but intend to cover all such changes and modifications as are encompassed by the scope of the appended claims.

We claim:

1. Spinning machine apparatus comprising:

a plurality of spinning units, each having an open-end spinning rotor for spinning thread, a bobbin holder at each spinning unit for holding bobbins to wind up thread produced by the spinning units, a supply station fixedly disposed at each spinning unit for storing a supply of at least one empty spool tube to be wound, each of said empty spool tubes being provided with a starter thread thereon of a length sufficient for at least one winding on process, tube transfer means carried by a traveling servicing device guided on tracks for movement to respective servicing positions adjacent respective spinning units, said tube transfer means including means for automatically sequentially removing a full bobbin from one of said bobbin holders and transferring one of said empty spool tubes from a respective supply station at a spinning unit to said bobbin holder, and means for returning a free end of the respective starter thread to a spinning rotor of a spinning unit to accommodate a piecing operation, whereby the supply of the prepared empty spool tubes at said supply stations simplifies the constructional arrangement of the automatic tube transfer means while providing the advantages of substantially automatic bobbin changing operations for an open-end spinning machine.

2. Apparatus according to claim 1, wherein a conveyor belt is provided which runs lengthwise to the machine, and wherein said tube transfer means includes an ejector device having means for lifting and spreading arms of the bobbin holder.

3. Apparatus according to claim 1, wherein said travelling servicing device further includes means for checking the degree of fullness of bobbins in the respective bobbin holders, and wherein said travelling servicing device includes means for interrupting the spinning operation of a spinning unit.

4. Apparatus according to claim 1, wherein said supply stations are mounted by position adjustable means to said tracks for said servicing travelling device.

5. Apparatus according to claim 1, wherein said servicing travelling device is designed as a maintenance device, said device comprising means for carrying out maintenance work which serves as preparation of a spinning unit for an automatic winding-on process to follow the bobbin-tube exchange.

6. Apparatus according to claim 3, wherein said supply stations are mounted by position adjustable means to said tracks for said servicing travelling device.

7. A method of operating an open-end spinning machine of the type having a plurality of spinning units comprising:

placing a supply of prepared empty spool tubes with a starter thread in respective supply stations fixedly disposed at each spinning unit, conducting spinning operations at said spinning units with spun thread being transferred to a bobbin held by a bobbin holder at each spinning unit, by means of a movable servicing device traveling between respective servicing positions at said spinning units, automatically sequentially removing a full bobbin from a respective one of said bobbin holders and transfering one of said prepared empty spool tubes from a respective supply station at a spinning unit to said respective bobbin holder, and returning of a free end of the starter thread to a spinning rotor of said respective spinning unit to accommodate piecing operation.

8. A method according to claim 7, wherein said placing includes manually placing said supply of prepared empty spool tubes in said respective supply stations.

9. A method according to claim 7, wherein said spinning operations are interrupted at a spinning unit during said automatically sequentially removing and transferring operation.

* * * * *